US005983597A

United States Patent [19]

Venturi et al.

[11] Patent Number: 5,983,597

[45] Date of Patent: Nov. 16, 1999

[54] METHOD AND DEVICE FOR FEEDING SHEET MATERIAL

[75] Inventors: Giuseppe Venturi, Richmond, Va.; Fiorenzo Draghetti, Medicina, Italy; Fulvio Boldrini, Ferrara, Italy; Marco Ghini, S. Lazzaro di Savena, Italy

[73] Assignee: G.D. Societa' Per Azioni, Bologna, Italy

[21] Appl. No.: 08/982,680

[22] Filed: Dec. 2, 1997

[30] Foreign Application Priority Data

Dec. 4, 1996 [IT] Italy ..... BO96A0629

[51] Int. Cl.[6] ..... B65B 41/12

[52] U.S. Cl. ..... 53/389.2; 53/228; 53/389.3; 34/360; 34/465; 34/583

[58] Field of Search ..... 53/228, 389.2, 53/389.3; 271/97; 34/359, 360, 460, 465, 576, 583

[56] References Cited

U.S. PATENT DOCUMENTS

| | | | |
|---|---|---|---|
| 3,210,911 | 10/1965 | Schmermund | 53/228 |
| 3,385,026 | 5/1968 | Schmermund | 53/389.3 |
| 3,485,429 | 12/1969 | Hutzenlaus | 34/360 |
| 3,967,767 | 7/1976 | Seragnoli | 53/389.3 |
| 5,179,815 | 1/1993 | Cahill et al. | 53/389.3 |
| 5,425,217 | 6/1995 | Lobash et al. | 53/389.3 |
| 5,522,207 | 6/1996 | Kelip | 53/389.2 |

FOREIGN PATENT DOCUMENTS

| | | |
|---|---|---|
| 0 502 417 | 4/1982 | European Pat. Off. . |
| 0 094 151 | 11/1983 | European Pat. Off. . |
| 0182 112 | 5/1986 | European Pat. Off. . |
| 11 86 473 | 2/1962 | Germany . |
| 32 34 155 | 3/1984 | Germany . |

*Primary Examiner*—John Sipos
*Attorney, Agent, or Firm*—Klauber & Jackson

[57] ABSTRACT

A method and device for feeding sheet material, whereby the sheet material is fed in a given traveling direction along one face of a plate by a fluid bed movable along the face in the traveling direction; the fluid bed being formed by at least one jet of fluid, which is directed in a direction substantially tangent to the face and concordant with the traveling direction, and is fed inside a window formed through the plate.

19 Claims, 3 Drawing Sheets

METHOD AND DEVICE FOR FEEDING SHEET MATERIAL

BACKGROUND OF THE INVENTION

The present invention relates to a method of feeding sheet material.

The present invention may be used to advantage for feeding sheets of wrapping material to a folding station of a cellophaning machine for cellophaning packets of cigarettes, to which the following description refers purely by way of example.

On cellophaning machines, the packets for wrapping are fed successively through a folding station along a first path extending in a first direction; corresponding sheets of wrapping material are fed successively to the folding station along a second path extending in a second direction substantially perpendicular to the first direction; and each sheet is arrested at the folding station in such a position as to interfere with the first path and be carried off and folded into a U by the respective packet traveling through the folding station, and so commence the formation of a tubular wrapping about the packet.

On known cellophaning machines of the above type, the sheets of wrapping material are fed through and arrested at the folding station by a pair of suction belts, which extend in the second direction, engage two opposite peripheral longitudinal portions of the sheet, are separated by a distance greater than the width of the packets, and are located on either side of the path along which the packets are fed.

The two suction belts described pose several drawbacks, on account of the normally limited amount of space available, and the complex structure resulting from the pneumatic suction devices of the belts at the folding station.

Moreover, the belts generate concentrated low-pressure regions, which are unsuitable for conveying relatively thin sheet material, particularly material of a few microns in thickness.

SUMMARY OF THE INVENTION

It is an object of the present invention to provide a method of feeding sheet material, designed to overcome the aforementioned drawbacks.

According to the present invention, there is provided a method of feeding sheet material, whereby the sheet material is conveyed in a given traveling direction; the method being characterized in that the sheet material is conveyed along one face of a plate by means of a fluid bed movable along said face in said traveling direction; said fluid bed being formed by at least one jet of fluid, which is directed in a direction substantially tangent to said face and concordant with said traveling direction, and is fed inside a chamber defined by a window formed through said plate.

The present invention also relates to a device for feeding sheet material.

According to the present invention, there is provided a device for feeding sheet material, and comprising a pneumatic conveyor for feeding the material in a given traveling direction; characterized in that said conveyor comprises a plate having a face which is substantially contacted by the sheet material; at least one chamber formed in said plate and defined by a window formed through the plate; a nozzle terminating in said chamber; and supply means for supplying fluid to said nozzle; the nozzle being so oriented as to direct a jet of said fluid in a direction substantially tangent to said face and concordant with said traveling direction.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
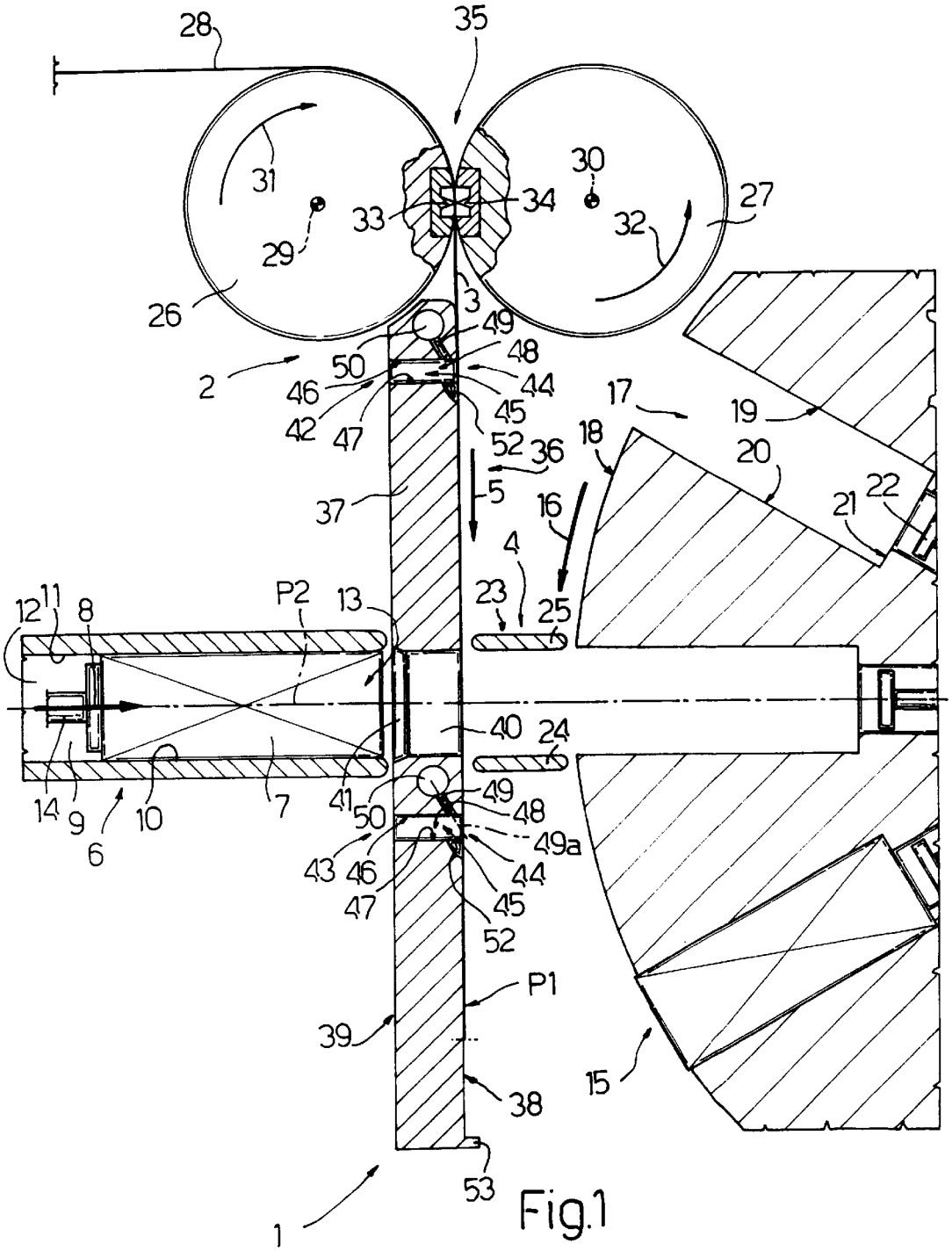
FIG. 1 shows a schematic section of a preferred embodiment of the device according to the present invention.

Number 1 in FIG. 1 indicates as a whole a cellophaning machine comprising a device 2 for feeding sheets 3 of wrapping material to a folding station 4 in a direction 5 and along a substantially vertical path P1; and a device 6 for feeding packets 7, crosswise to their longitudinal axis, to folding station 4 in a direction 8 substantially perpendicular to direction 5, and along a path P2 (indicated by the dot-and-dash line in FIG. 1) perpendicular to path P1.

Device 6 comprises a conduit 9 defined by a bottom wall 10, a top wall 11, and two lateral walls 12 (only one shown in FIG. 1), and in turn comprising an input opening (not shown) and an output opening 13, between which packets 7 are fed by means of a pusher 14.

Machine 1 also comprises a wrapping wheel 15 rotating in a direction 16 (anticlockwise in FIG. 1) about an axis (not shown) perpendicular to the FIG. 1 plane and to path P2, and in turn comprising a number of pockets 17 equally spaced about the outer surface 18 of wheel 15. Each pocket 17 extends radially, and comprises a top face 19, a bottom face 20, and an end face 21 fitted through with a radial pusher 22.

A folding spindle 23 is located between conduit 9 and wrapping wheel 15, and comprises a bottom plate 24 and a top plate 25 aligned respectively with bottom wall 10 and top wall 11 of conduit 9. Spindle 23 is adjacent to the outer surface 18 of wheel 15, and constitutes an ideal extension of both conduit 9 and a stationary pocket 17 aligned with path P2 in station 4.

Device 2 for feeding sheets 3 comprises a first and second roller 26, 27 for feeding a strip 28 of wrapping material, and which rotate about respective axes 29, 30 in respective opposite directions 31, 32, and respectively comprise a blade 33 and a counterblade 34, which are operated in time with each other to cut a sheet 3 off strip 28 at a cutting station 35 for each turn of rollers 26, 27.

In addition to rollers 26 and 27, device 2 also comprises a pneumatic conveyor 36 located immediately downstream from station 35 in direction 5, and in turn comprising a flat plate 37 located between conduit 9 and spindle 23, and having a first and second face 38 and 39 opposite and parallel to each other and perpendicular to the traveling direction 8 of packets 7. In the example shown, the point of contact of rollers 26 and 27 is tangent to the ideal extension of face 38 facing spindle 23.

Figure 2:
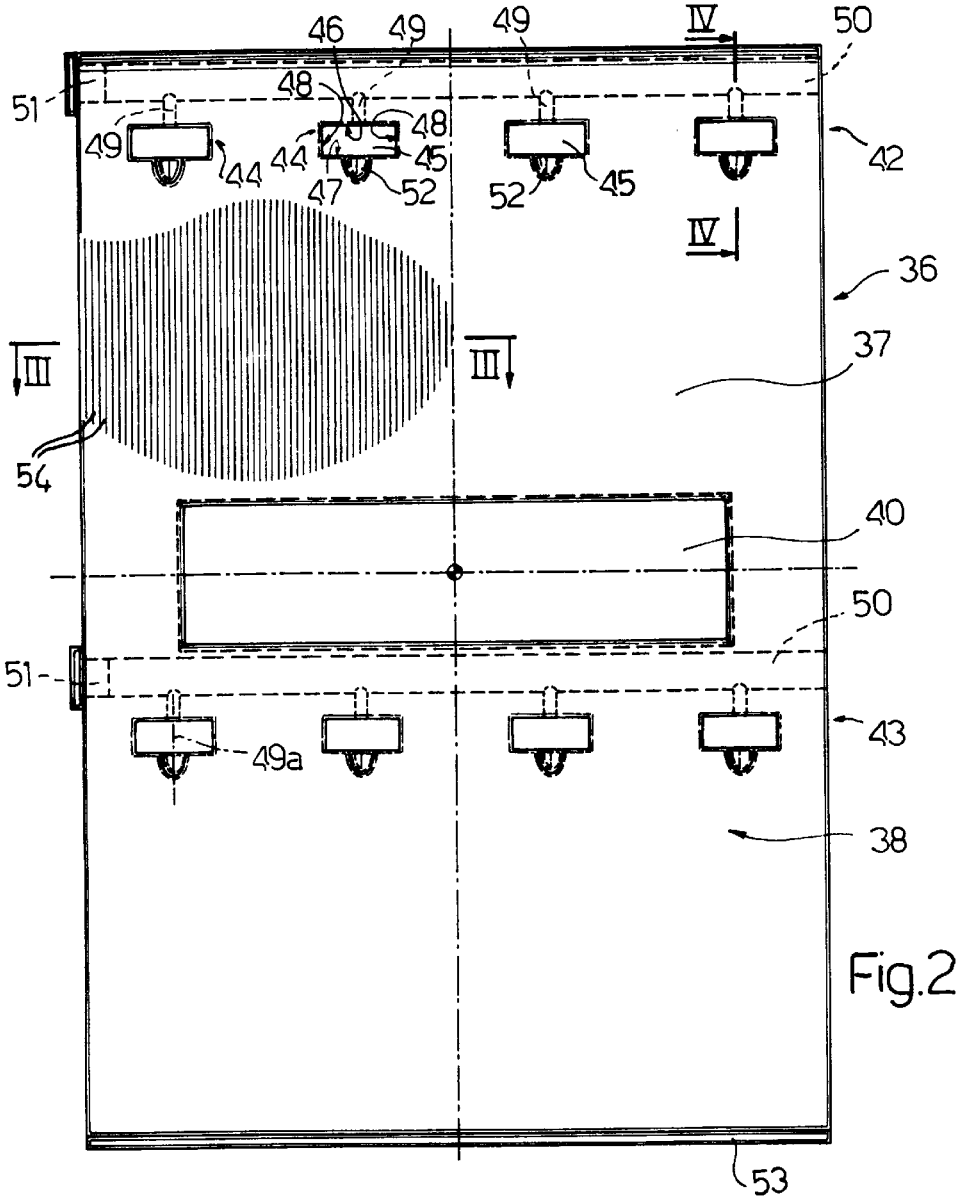
FIG. 2 shows a front view of the FIG. 1 device.

With reference to FIGS. 1 and 2, plate 37 comprises an opening 40 aligned with conduit 9 and spindle 23 to permit the passage through plate 37 of packets 7 traveling along path P2. To assist the passage of packets 7, opening 40 comprises a flared lead-in portion 41 facing conduit 9.

Plate 37 also comprises two series 42, 43 of fluidic feed devices 44, each series 42, 43 comprising a succession of fluidic devices 44 equally spaced along plate 37 in a direction perpendicular to the FIG. 1 plane. Series 42 is located close to the end of plate 37 adjacent to rollers 26 and 27, and series 43 close to opening 40, on the opposite side of opening 40 to series 42.

Each device 44 comprises a substantially rectangular-section opening 45 formed through plate 37 and in turn comprising a top surface 46 and bottom surface 47 crosswise to direction 5, and two lateral surfaces 48 parallel to direction 5. Each opening 45 connects faces 38 and 39, and defines an expansion chamber for a compressed air jet (not shown) fed into opening 45 by a respective nozzle 49 connecting opening 45 to a compressed air supply header 50 common to devices 44 in each series 42, 43 and formed in the thickness of plate 37.

As shown in FIG. 2, one end of each header 50 is closed by a plug 51, while the other end is open and communicates with a compressed air generator (not shown).

Figure 4:
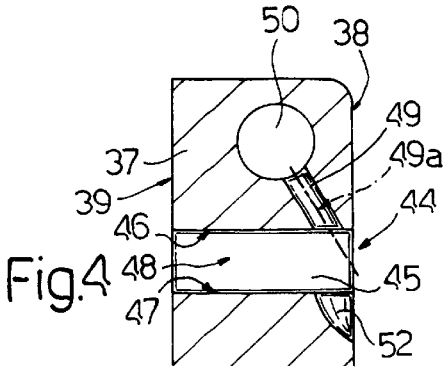
FIG. 4 shows a section along line IV—IV in FIG. 2.

As shown in FIG. 4, each nozzle 49 is formed in the thickness of plate 37, communicates with respective opening 45 through surface 46 of opening 45, and is inclined slightly with respect to faces 38 and 39 to direct the jet (not shown) in a direction 49*a* substantially tangent to face 38 and concordant with direction 5. To enable the jet (not shown) to flow out in direction 49*a,* each opening 45 communicates with a semiparaboloidal cavity 52, which is formed in face 38 and through surface 47, has an axis substantially parallel to direction 5, and is positioned with the base at surface 47 and substantially aligned with respective nozzle 49.

As shown in FIGS. 1 and 2, the bottom end of plate 37 comprises an appendix 53 crosswise to direction 5 and projecting from face 38 to arrest each sheet 3 in a folding position in which a given central portion of sheet 3 closes opening 40.

Figure 3:
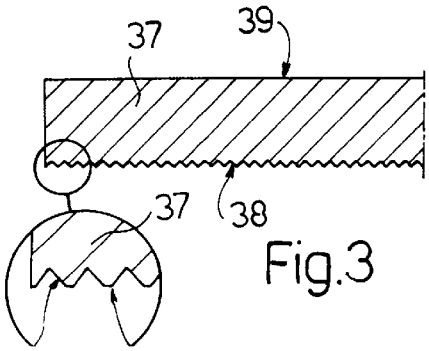
FIG. 3 shows a section along line III—III in FIG. 2.

As shown in FIGS. 2 and 3, face 38 of plate 37 comprises a series of equally spaced grooves 54 extending in direction 5.

In actual use, device 2 supplies strip 28 by means of rollers 26 and 27, which feed a leading portion of strip 28 onto face 38 of plate 37 at the first series 42 of devices 44, by which strip 28 is fed along, and maintained contacting, face 38.

More specifically, the air supplied by each nozzle 49 expands inside respective opening 45 to form a vacuum which would "stick" strip 28 to face 38, if face 38 did not communicate with air at atmospheric pressure on face 39; which communication tends to eliminate the static vacuum inside opening 45, while leaving unchanged a fairly small dynamic vacuum caused by the eddies in the expanding jet from nozzle 49. The jet is subsequently directed by respective cavity 52 into a gap between strip 28 and face 38, and is divided by grooves 54 into elementary filaments, which flow along grooves 54 in direction 5. On contacting strip 28 and the walls of respective groove 54, each elementary filament settles into a laminar filament, which has a pressure lower than ambient pressure and combines with all the other filaments to form a fluid bed supporting and retaining strip 28 on face 38. As the fluid bed flows along face 38 in direction 5 at a speed parallel to direction 5 and normally greater than the surface speed of rollers 26 and 27, strip 28 is subjected to traction, which provides for keeping strip 28 perfectly taut, and, once strip 28 is cut by blade 33 and counterblade 34, for detaching sheet 3 from the leading end of strip 28 until strip 3 comes to rest against appendix 53 in such a position as to be engaged correctly by a respective packet 7.

As the front end of packet 7 reaches face 38 of plate 37, packet 7 draws sheet 3 through folding spindle 23 and is arrested, together with the U-folded sheet 3, inside the pocket 17 of wrapping wheel 15 aligned with path P2.

Figure 5:
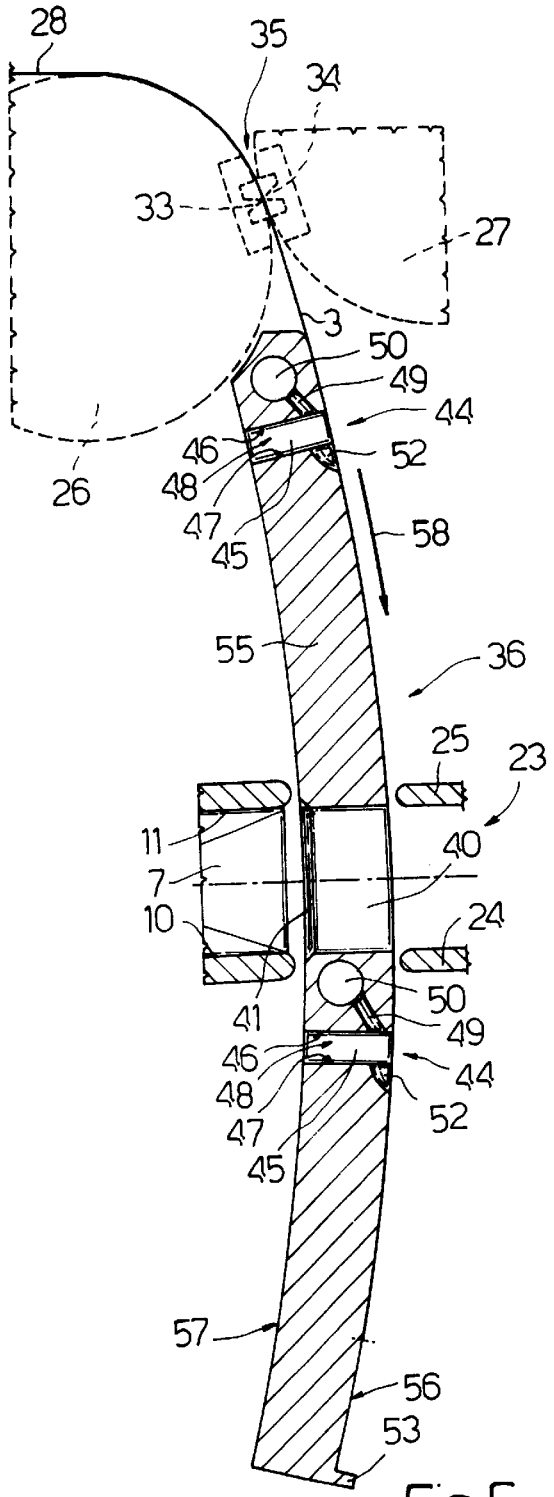
FIG. 5 shows a longitudinal section of a first variation of a detail in FIG. 1.

In the FIG. 5 variation, plate 37 is replaced by a curved plate 55 comprising, like plate 37, two series 42, 43 of fluidic devices 44 supplied by headers 50; an opening 40, aligned with conduit 9, for the passage of packets 7; and an appendix 53 for arresting sheets 3.

Plate 55 is substantially in the form of a cylindrical sector extending about an axis (not shown) perpendicular to the FIG. 5 plane, and comprises a convex face 56 facing spindle 23, and an opposite concave face 57.

In actual use, strip 28 is fed by devices 44 along face 56 in a direction 58 in the same way as for plate 37; and, once cut off strip 28, each sheet 3 is fed forward until the leading end comes to rest against appendix 53. The curved shape of face 56 and, therefore, of sheet 3 resting against appendix 53 prevents the leading edge of sheet 3, as sheet 3 contacts appendix 53, from being so stressed axially as to cause sheet 3 to collapse and so yield locally due to compression. The curved shape of sheet 3, in fact, converts such stress into a bending moment, which is absorbed elastically by the sheet.

Figure 6:
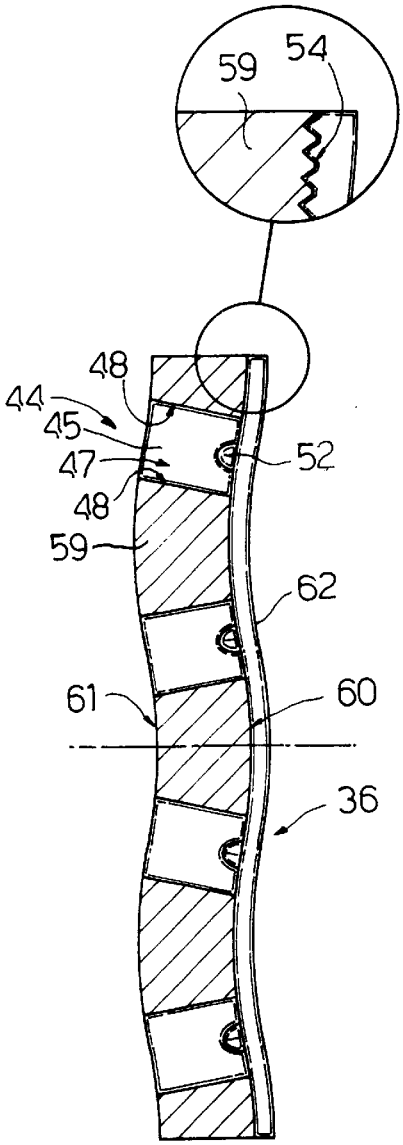
FIG. 6 shows a cross section of a second variation of a detail in FIG. 1.

In the FIG. 6 variation, plate 37 is replaced by a plate 59 having two opposite, parallel, undulated faces 60 and 61, and wherein the undulations of face 60 facing spindle 23 extend parallel to direction 5. Like plate 37, plate 59 comprises two series 42, 43 of fluidic devices 44 supplied by headers 50; an opening 40, aligned with conduit 9, for the passage of packets 7; and an appendix 62 for arresting sheets 3.

In actual use, sheet 3 on undulated face 60 also assumes an undulated shape, which, as compared with a flat configuration, greatly increases the axial rigidity of sheet 3, increases the resistance to axial stress of sheet 3, and ensures that any axial stress on the leading edge of sheet 3, as sheet 3 contacts appendix 62, is not such as to cause sheet 3 to collapse and so yield locally due to compression.

We claim:

1. A method of feeding sheet material, whereby the sheet material is conveyed in a given traveling direction; the method being characterized in that the sheet material is conveyed along one face of a plate by means of a fluid bed movable along said face in said traveling direction; said fluid bed being formed by at least one jet of fluid, which is directed along to said face in a direction that substantially goes along with said traveling direction, and is fed inside a chamber defined by a window formed through said plate;

the sheet being arrested in a given position along said face;

the jet of fluid being ejected from a nozzle formed in the plate and terminating in said chamber.

2. A method as claimed in claim 1, characterized in that the sheet material (3;28) comprises a strip (28) of wrapping material from which a sheet (3) is detached cyclically as the strip (28) is conveyed along said face (38; 56; 60).

3. A method as claimed in claim 2, wherein said stop means comprise an appendix extending crosswise to said traveling direction and projecting outwards from said face.

4. A method as claimed in claim 1, wherein said face is a convex face extending substantially about an axis crosswise to said traveling direction.

5. A method as claimed in claim 1, wherein said face comprises undulations parallel to said traveling direction.

6. A method as claimed in claim 1, wherein said fluid bed is formed by dividing said jet by means of grooves formed in said face and parallel to said traveling direction.

7. A method as claimed in claim 2, wherein said plate comprises an opening for the passage of a product to be wrapped in said sheet, which, when in said given position, closes said opening; said product being fed through said opening in time with arrest of the sheet in said given position, to detach the sheet from said plate and feed the sheet through folding means for folding the sheet into a U about the product.

8. A device for feeding sheet material, and comprising a pneumatic conveyor for feeding the material in a given traveling direction; wherein said conveyor comprises a plate having a face which is substantially contacted by the sheet material; at least one chamber formed in said plate and defined by a window formed through the plate; a nozzle formed in the plate and terminating in said chamber; and supply means for supplying fluid to said nozzle; the nozzle being so oriented as to direct a jet of said fluid along said face and in a direction that substantially goes along with said traveling direction;

wherein stop means are provided for arresting said sheet material in a given position along said face.

9. A device as claimed in claim 8, said device including a cavity formed in said face and communicating with said window; the cavity being substantially aligned with said nozzle.

10. A device as claimed in claim 9, wherein said window comprises a first and second surface crosswise to the traveling direction of the sheet material; the first surface being upstream from the second surface in said traveling direction; and the nozzle extending through said first surface.

11. A device as claimed in claim 10, wherein said cavity is semiparaboloidal with an axis parallel to said traveling direction and with the base at said second surface.

12. A device as claimed in claim 8, wherein said face of the plate comprises grooves parallel to said traveling direction.

13. A device as claimed in claim 8, wherein the plate comprises a first and second series of windows, and an opening for the passage of a product; said first and second series being located respectively up- and downstream from said opening in said traveling direction.

14. A device as claimed in claim 13, characterized in that said stop means arrest said sheet material in said given position closing said opening.

15. A device as claimed in claim 14, wherein said stop means comprise an appendix, which extends crosswise to said traveling direction, is integral with said plate, is located downstream from said opening in said traveling direction, and projects from said face.

16. A device as claimed in claim 8, wherein said face is a flat face.

17. A device as claimed in claim 8, wherein said face is a convex face extending substantially about an axis crosswise to said traveling direction.

18. A device as claimed in claim 8, wherein said face comprises undulations parallel to said traveling direction.

19. A device for feeding sheet material, said device comprising:

a pneumatic conveyor for feeding the material in a given traveling direction;

wherein said conveyor comprises a plate having a face which is substantially contacted by the sheet material;

at least one chamber formed in said plate and having an aperture defined by a window formed through the plate; a nozzle terminating in said chamber;

supply means for supplying fluid to said nozzle; the nozzle being so oriented as to direct a jet of said fluid along said face and in a direction that substantially goes along with said traveling direction;

a cavity formed in said face and communicating with said window; the cavity being substantially aligned with said nozzle;

wherein said window comprises a first and second surface crosswise to the traveling direction of the sheet material; the first surface being upstream from the second surface in said traveling direction; and the nozzle extending through said first surface; and wherein said cavity is semiparaboloidal with an axis parallel to said traveling direction and with the base at said second surface.

* * * * *